United States Patent [19]

Shenker

[11] 4,209,028

[45] Jun. 24, 1980

[54] LANCE CONSTRUCTION FOR BOILER CLEANING APPARATUS

[75] Inventor: Jack D. Shenker, Lancaster, Ohio

[73] Assignee: Babcock & Wilcox Company, New Orleans, La.

[21] Appl. No.: 43,048

[22] Filed: May 29, 1979

[51] Int. Cl.[2] ..... B08B 3/02; B08B 9/02

[52] U.S. Cl. ..... 134/56 R; 134/167 C; 15/316 A; 122/390

[58] Field of Search ..... 15/316 R, 316 A; 122/379, 390; 134/56 R, 166 C, 167 C, 168 C, 169 C

[56] References Cited

U.S. PATENT DOCUMENTS

| | | | |
|---|---|---|---|
| 1,599,283 | 9/1926 | Phillips | 15/316 R |
| 3,782,336 | 1/1974 | Nelson | 122/379 |

FOREIGN PATENT DOCUMENTS

| | | | |
|---|---|---|---|
| 2251779 | 5/1974 | Fed. Rep. of Germany | 15/316 R |
| 686842 | 2/1953 | United Kingdom | 15/316 R |

*Primary Examiner*—Robert L. Bleutge

*Attorney, Agent, or Firm*—Harness, Dickey & Pierce

[57] ABSTRACT

A lance tube for soot blowers having a steam nozzle near its end, a liquid nozzle spaced rearwardly from the steam nozzle, and a thermostatically operable valve interposed between the nozzles which closes off the steam nozzle when liquid at a temperature lower than that of steam is in the lance tube.

10 Claims, 1 Drawing Figure

LANCE CONSTRUCTION FOR BOILER CLEANING APPARATUS

BACKGROUND OF THE INVENTION

Blowers for removing slag and other fouling materials from the heated surfaces of large boilers and other heat exchangers such as are employed in public utility and industrial applications have generally employed steam as the blowing medium. It has been known for many years that where steam jets will not remove the fouling material, it can frequently be dislodged by means of a water jet. Until the development of the variable speed/constant progression-high energy water cleaning system disclosed in U.S. Pat. No. 3,782,336, granted Jan. 1, 1974, to John E. Nelson, it was frequently infeasible to utilize a waterjet however, because of the thermal shock induced by prior water cleaning systems. In many cases it was therefore necessary to shut down the boiler periodically, allow it to cool, and remove solidified slag with jackhammers and/or explosives. Although the system of the Nelson patent enabled slag removal by water in situations which previously prevented its use, it is of course preferable to avoid any thermally induced stresses whatever, except when steam blowing is not effective. Where fossil fuels are being burned, the rate of slag buildup and the tenacity of the slag are apt to vary, and successful removal by steam may be possible for some periods but not at all times. The object of the present invention is to provide an improved lance tube construction having separate nozzles for water and for steam and incorporating simple, reliable automatic means for closing the steam nozzle when water is fed to the lance, and for automatically opening the steam nozzle when steam is fed to the lance.

Other objects and advantages will become apparent to persons skilled in the art upon consideration of the present disclosure in its entirety.

BRIEF DESCRIPTION OF THE FIGURES OF DRAWING

FIG. 1 is a diametric longitudinal sectional view of the outer end portion of a lance tube assembly constructed in accordance with the present invention, and FIG. 2 is a similar view showing a modification.

DETAILED DESCRIPTION OF PREFERRED FORMS OF THE INVENTION

Figure 1:
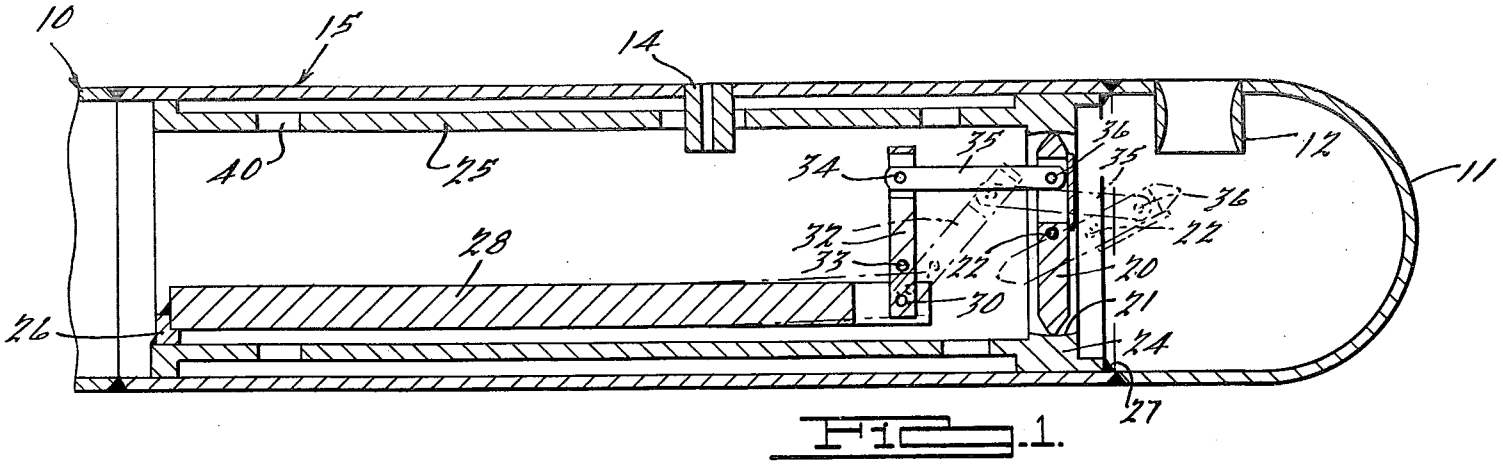

Referring particularly to FIG. 1, the main body of the lance tube is generally designated 10 and may consist of a suitable steel alloy tube of the type generally employed. A nozzle support 15 forming a terminal extension of lance tube 10 has a closed outer end 11 and at a position close to its outer end has a nozzle 12 of relatively large diameter suitable for discharging steam against surfaces to be cleaned. The construction and arrangement of the steam nozzle 12 may follow conventional practice.

At a position farther from the nose portion 11, the wall of the lance tube carries a nozzle 14 containing a smaller discharge port and which is suitable for discharging a liquid cleaning medium such as water. In this connection it will be appreciated that although water is ordinarily used, the liquid medium sometimes consists of water containing an alkaline constituent, although the operating principles are of course the same.

A butterfly-type thermostatically operable valve element 20 is arranged to selectively control flow of fluid to the steam nozzle at the outer extremity of the assembly. The butterfly valve element 20 is pivoted on a pin 22 fixed in a transverse wall 24 which forms the outer end of a sleeve 25 extending longitudinally within the nozzle support 15 from a position near the rear end of nozzle support to a position intermediate the water and steam nozzles. At its rear end sleeve 25 is free to move relative to the nozzle support 15. Wall 24 is welded to the body 15 at 27.

Contained in the sleeve 25 and secured firmly at its rear end as by welding to a bracket 26 which is in turn secured to the inner wall of sleeve 25 is an elongated bar 28 formed of a material having a low coefficient of expansion relative to the coefficient of expansion of the body 25. Member 28 may be formed of a suitable iron-nickel alloy such as "Invar", while sleeve 25 is formed of stainless or carbon steel. At its forward end the bar 28 is connected as by a pivot 30 to a lever 32 fulcrumed on a pin 33 in the body 25. At its other end the lever 32 is connected by pivot means 34 to a link 35 connected by pivot means 26 to the butterfly valve 20. The lever arm 33–34 is substantially longer than the lever arm 30–33.

When the system as described is subjected to heat, the sleeve 25 expands longitudinally more rapidly than the bar 28, carrying the pivots 22 and 33 to the right, as shown in FIG. 1, with respect to the pivot 30. Lever 32 thus rocks clockwise, opening the valve 20. When steam is supplied to the lance tube 10, as is the practice when the fouling material can be removed by that medium, the heating effect of the steam opens the valve in the manner indicated. When liquid, normally water, is fed to the lance tube, its cooling effect causes the sleeve 25 to contract longitudinally to a greater extent than the bar 28, and reverse actuation of the valve occurs, moving it counter-clockwise to the closed position. The end wall 24 is relatively thick, and the butterfly member 20 is closely movably fitted in a spherical internal opening 21 in the wall, so that the valve is effectively closed during a range of movement.

Except at its ends, the peripheral wall of the sleeve 25 is somewhat spaced from the internal wall of nozzle support 15. Both steam and water are admitted to the space between members 25–15 through openings as 40 in the wall of body 25.

During steam blowing, a relatively small quantity of steam is also projected through the water nozzle 14, whereas during water blowing, the larger steam nozzle is closed, and the full water pressure is thus available at the water nozzle 14.

Figure 2:
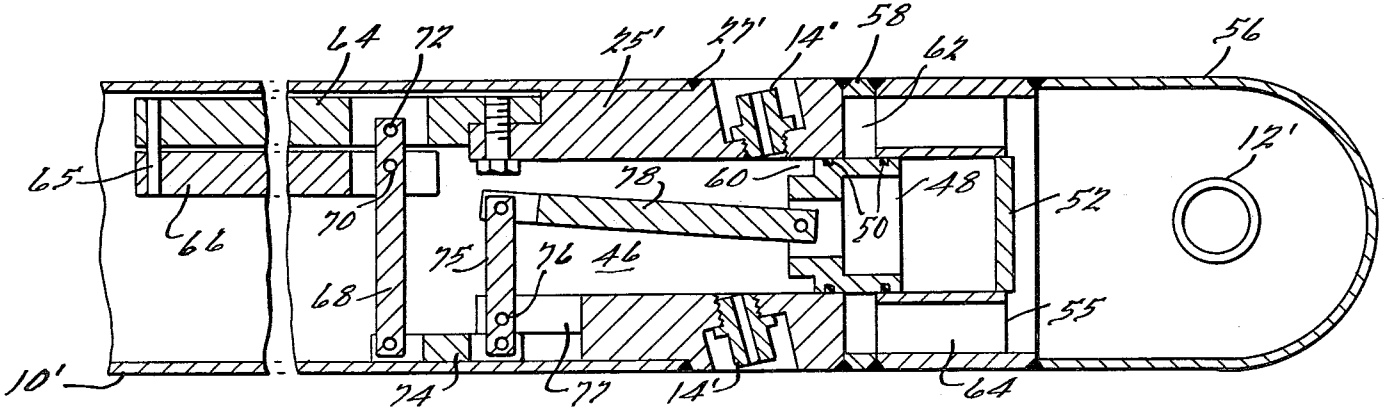

In the modified construction shown in FIG. 2, parts corresponding to parts already described are designated by like reference characters primed. The forward end of the lance tube 10' is secured in fluid-tight relation as by welding at 27' to a sleeve 25' of annular cross section having a relatively large axial cylindrical passage 46 extending therethrough. Sleeve 25' also carries a pair of water jet nozzles 14' which communicate with the passage 46 and the exterior. Slidable in the forward end of passage 46 is a cylindrical valve member 48 which is slidable in passage 46. Radial holes 62 and intersecting longitudinal holes 55 are located in the forward portion of 25'. Plugs 58 are welded into the outside of the radial holes to seal these passages from the outside.

At its rear end the valve member 48 is peripherally rabbeted to provide an annular space 60 which is open toward the rear and which when the valve 48 is moved forwardly, aligns with the holes 62, so that fluid communication is established between the lance tube and the steam nozzle via passage 46, annular space 60, radial holes 62 and the longitudinal holes 64 in sleeve 25'.

Valve 48 is controlled by a thermostatic actuating mechanism consisting of a bar 64 attached to the sleeve 25' and extending rearwardly within the lance tube. Bar 64 may be formed of carbon or stainless steel or other material having a relatively high coefficient of expansion. At its rear end bar 64 is secured as by the pin 65 to a bar 66 which extends forwardly parallel to the bar 64 and is expansible and contractable independently. The bar 66 is formed of material having a very low coefficient of expansion, such as "Invar". A transverse lever 68 is pivoted to the free outer end of the bar 66 by a pin 60, and is pivoted to the bar 64 near the secured end of the latter by a pin 72. Lever 68 is connected by a longitudinal link 74 to a second transverse lever 75 fulcrumed on a pin 76 fast in a lug portion 77 projecting rearwardly from the sleeve 25'. A longitudinal link 78 connects the other end of lever 75 to the piston valve 48.

When the system is at a temperature substantially lower than that of steam, the parts stand as shown in FIG. 2, at which time the piston valve 48 closes off the passages 62, 64, so that fluid cannot reach the steam nozzle 12'. Ring seals 50 are provided on the piston 48 engaging the cylinder 25'. Liquid, however, can be discharged through the nozzles 14'. When steam is introduced into the system it heats the bars 64,66. The bar 64 expands to a greater degree than the bar 66, and since the bars are connected at the outer or rear end by the pin 65, the pivot 70 is carried toward the left as viewed in the drawing with respect to the pivot 62, moving the link 74 to the left and rocking the lever 75 clockwise, thereby moving the piston valve 48 to the right to align the rabbeted channel 60 with the passages 62 and effectively open the steam port and permit discharge of steam therefrom.

While preferred embodiments of the invention have been described herein, it will be appreciated that various modifications and changes may be made without departing from the spirit and scope of the appended claims.

This description of the preferred embodiments, and the accompanying drawings, have been furnished in compliance with the statutory requirement to set forth the best mode contemplated by the inventor of carrying out the invention. The prior portions consisting of the "Abstract of theDisclosure" and the "Background of the Invention" are furnished without prejudice to comply with administrative requirements of the Patent Office.

What is claimed is:

1. A lance tube assembly for soot blowers and the like comprising a closed-end tubular structure adapted to project into a heat exchanger and to which either steam or a liquid at lower than steam temperatures can be fed to be discharged against fouled surfaces, characterized by the combination which includes a liquid nozzle in the structure at a position spaced from the end of the structure, a steam nozzle of larger cross section positioned closer to the end of the structure, valving means for opening and closing communication to the steam nozzle, and temperature sensing means in the structure for opening said valving means when said temperature sensing means is at or above steam temperature and for closing said valving means when a lower temperature is imposed on said sensing means by a liquid in the structure.

2. An assembly as defined in claim 1 including a movable valve element and thermostatic actuating means for said valve element comrising a pair of actuating members having different coefficients of expansion.

3. An assembly as defined in claim 2 wherein one of said actuating members comprises a tubular sleeve fitted in said tubular structure and carrying said valve element and the other of said actuating members is a bar mounted on the sleeve.

4. An assembly as defined in claim 2 wherein one of said actuating members is a sleeve fitted in said tubular structure and carrying said valve element and the other of said actuating members is a bar in the sleeve.

5. An assembly as defined in either of claims 2 and 4 wherein the bar has a lower coefficient of expansion than the sleeve.

6. An assembly as defined in claim 4 including a partitioning wall at a position between the nozzles, the valve element comprising a butterfly element in the partitioning wall.

7. An assembly as defined in claim 3 wherein the water nozzle extends through the peripheral wall of the sleeve.

8. An assembly as defined in claim 2 wherein said valving means includes a body having a valve port therein and a valving member movable to open and close the port, one of said actuating members being comprised at least partly by said body.

9. An assembly as defined in claim 2 wherein said valving means includes a body having a valve port therein and a valving member movable to open and close the port, the actuating member which has the larger coefficient of expansion being comprised at least partly by said body.

10. An assembly as defined in claim 2 wherein said valving means includes a body having a valve port therein and a valving member movable to open and close the port, said actuating means comprising a pair of bars secured to the body and operatively connected to the valving member.

* * * * *